US009169526B2

(12) United States Patent
Park

(10) Patent No.: US 9,169,526 B2
(45) Date of Patent: Oct. 27, 2015

(54) NODULAR GRAPHITE CAST IRON

(71) Applicant: LG Electronics Inc., Seoul (KR)

(72) Inventor: Jaebong Park, Changwon-Si (KR)

(73) Assignee: LG ELECTRONICS INC., Seoul (KR)

( * ) Notice: Subject to any disclaimer, the term of this patent is extended or adjusted under 35 U.S.C. 154(b) by 299 days.

(21) Appl. No.: 13/675,818

(22) Filed: Nov. 13, 2012

(65) Prior Publication Data

US 2013/0122325 A1 May 16, 2013

(30) Foreign Application Priority Data

Nov. 14, 2011 (KR) ..... 10-2011-0118383

(51) Int. Cl.

| | |
|---|---|
| ***C22C 37/04*** | (2006.01) |
| ***C22C 37/06*** | (2006.01) |
| ***C22C 37/10*** | (2006.01) |
| ***C21C 1/10*** | (2006.01) |
| ***F01C 21/08*** | (2006.01) |
| ***B22D 25/02*** | (2006.01) |
| ***B22D 27/20*** | (2006.01) |
| ***C21D 5/00*** | (2006.01) |
| ***C21D 9/00*** | (2006.01) |
| ***C22C 33/08*** | (2006.01) |
| *F04C 18/356* | (2006.01) |

(52) U.S. Cl.

CPC ..... *C21C 1/105* (2013.01); *B22D 25/02* (2013.01); *B22D 27/20* (2013.01); *C21D 5/00* (2013.01); *C21D 9/0068* (2013.01); *C22C 33/08* (2013.01); *C22C 37/04* (2013.01); *C22C 37/06* (2013.01); *C22C 37/10* (2013.01); *F01C 21/0809* (2013.01); *F04C 18/356* (2013.01); *F04C 2230/21* (2013.01); *F05C 2201/0442* (2013.01); *Y10T 428/1266* (2015.01)

(58) Field of Classification Search

None

See application file for complete search history.

(56) References Cited

U.S. PATENT DOCUMENTS

| | | | | |
|---|---|---|---|---|
| 3,144,359 | A * | 8/1964 | Takahashi | 148/242 |
| 4,619,713 | A | 10/1986 | Suenaga et al. | |
| 5,028,281 | A * | 7/1991 | Hayes et al. | 148/321 |
| 5,972,128 | A | 10/1999 | Miwa | |

FOREIGN PATENT DOCUMENTS

| | | | |
|---|---|---|---|
| CN | 1846887 | A | 10/2006 |
| CN | 102041428 | A | 5/2011 |

(Continued)

OTHER PUBLICATIONS

Jiang et al., "Effect of Austempering on Mechanical Properties of Dual Phase ADI", Apr. 2009, vol. 58, No. 4, pp. 368-372.

*Primary Examiner* — Deborah Yee

(74) *Attorney, Agent, or Firm* — Birch, Stewart, Kolasch & Birch, LLP

(57) ABSTRACT

A nodular graphite cast iron, a method for fabricating a vane for a rotary compressor using nodular graphite cast iron, and a vane for a rotary compressor using the same are provided. The nodular graphite cast iron includes 3.4 wt % to 3.9 wt % of carbon (C), 2.0 wt % to 3.0 wt % of silicon (Si), 0.3 wt % to 1.0 wt % of manganese (Mn), 0.1 wt % to 1.0 wt % of chromium (Cr), 0.04 wt % to 0.15 wt % of titanium (Ti), less than 0.08 w % of phosphorus (P), less than 0.025 wt % of sulphur (S), 0.03 wt % to 0.05 wt % of magnesium (Mg), 0.02 wt % to 0.04 wt % of rare earth resource, iron (Fe) and impurities as the remnants, and includes a bainite matrix structure, nodular graphite, and 15 vol % to 35 vol % of carbide.

10 Claims, 5 Drawing Sheets

(56) References Cited

FOREIGN PATENT DOCUMENTS

| | | | | |
|---|---|---|---|---|
| CN | 102251167 | A | | 11/2011 |
| CN | 102747268 | A | | 10/2012 |
| EP | 1 384 794 | A1 | | 1/2004 |
| GB | 1500766 | | * | 2/1978 |
| GB | 2 112 811 | A | | 7/1983 |
| JP | 59-157221 | A | | 9/1984 |
| JP | 60-36754 | A | | 2/1985 |
| JP | 61-3866 | A | | 1/1986 |
| JP | 2-30732 | A | | 2/1990 |
| JP | 2004-099923 | A | | 4/2004 |
| KR | 1992-0003213 | B1 | | 10/1986 |
| RU | 2 096 515 | C1 | | 11/1997 |
| SU | 1027264 | A | | 7/1983 |
| SU | 1154366 | A | | 5/1985 |
| SU | 1289905 | A1 | | 2/1987 |
| SU | 1310451 | A1 | | 5/1987 |
| SU | 1320255 | A1 | | 6/1987 |
| SU | 1406201 | A1 | | 6/1988 |
| SU | 1546511 | A1 | | 2/1990 |
| SU | 1749291 | A1 | | 7/1992 |
| WO | WO 97/32049 | A1 | | 9/1997 |

* cited by examiner

NODULAR GRAPHITE CAST IRON

This application claims benefit under 35 U.S.C. 119 to Korean Application No. 10-2011-0118383, filed on Nov. 14, 2011, which is herein expressly incorporated by reference in its entirety.

FIELD OF THE INVENTION

The present invention relates to a nodular graphite cast iron and a method for fabricating a vane for a rotary compressor using the same.

DESCRIPTION OF THE RELATED ART

In general, a compressor includes a driving motor generating driving force (or power) in an internal space of a shell and a compression unit coupled to the driving motor to compress a refrigerant. Compressors may be classified according to how a refrigerant is compressed. For example, in case of a rotary compressor, a compression unit includes a cylinder forming a compression space, a vane dividing the compression space of the cylinder into a suction chamber and a discharge chamber, a plurality of bearing members supporting the vane and forming the compression space together with the cylinder, and a rolling piston rotatably installed within the cylinder.

The vane is inserted into a vane slot formed in the cylinder and has an end portion fixed to an outer circumferential portion of the rolling piston to divide the compression space into two sections. The vane continuously slidably moves within the vane slot during a compression process. In this process, the vane is continuously in contact with a high temperature and high pressure refrigerant and maintained in a state of being tightly attached to the rolling piston and the bearing members to prevent a leakage of the refrigerant, so it is required to have high strength and wear resistance (or abrasion resistance).

In particular, in case of a new refrigerant such as HFC, or the like, replacing CFC not used any longer as an ozone-depleting substance, it has low lubricating performance relative to CFC, and the use of an inverter for reducing energy consumption requests a vane to have high wear resistance relative to the related art.

To meet the conditions, currently, vanes are fabricated by machining high speed steel or stainless steel to have a certain shape, and performing post-processing, such as a surface treatment, or the like, thereon. However, such vanes have an excessively high content of high-priced rare earth metals such as Gr, W, Mo, V, Co, and the like, and since they are process to have a certain shape through forging, productivity is low and cost is high. In particular, in order to increase wear resistance, vanes are to have high hardness, which makes it difficult to perform processing through forging.

SUMMARY OF THE INVENTION

An aspect of the present invention provides a nodular graphite cast iron that satisfies requirements for strength and wear resistance (or abrasion resistance) as a material of a vane and incurs low fabrication unit cost by increasing productivity.

Another aspect of the present invention provides a method for fabricating the foregoing vane.

According to an aspect of the present invention, there is provided a nodular graphite cast iron comprised of 3.4 wt % to 3.9 wt % of carbon (C), 2.0 wt % to 3.0 wt % of silicon (Si), 0.3 wt % to 1.0 wt % of manganese (Mn), 0.1 wt % to 1.0 wt % of chromium (Cr), 0.04 wt % to 0.15 wt % of titanium (Ti), less than 0.08 wt % of phosphorus (P), less than 0.025 wt % of sulphur (S), 0.03 wt % to 0.05 wt % of magnesium (Mg), 0.02 wt % to 0.04 wt % of rare earth resource, and iron (Fe) and impurities as the remnants, and including a bainite matrix structure, nodular graphite, and 15 vol % to 35 vol % of carbide.

Also, a spheroidizing agent and an inoculant may be added to nodular graphite cast iron in a state of being a molten metal taken out from a furnace. Here, the spheroidizing agent may be added in the amount of 1.0%~1.8% of the mass of molten metal.

Meanwhile, the bainite matrix structure of the nodular graphite cast iron may be obtained by transforming an austenite matrix structure through a heat treatment.

Here, the heat treatment may be austempering. In detail, the nodular graphite cast iron may be heated at a temperature ranging from 880° C. to 950° C., maintained at the temperature for 30 to 90 minutes, maintained in a liquid at a temperature ranging from 200° C. to 260° C. for 1 to 3 hours, and then, cooled in the air to reach room temperature. In this case, the liquid may be a nitrate solution in which KNO3 and NaNO3 are mixed in the weight ratio of 1:1.

Meanwhile, the nodular graphite cast iron having the transformed bainite matrix structure may be sulphurized to additionally include a sulphurized layer having a thickness ranging from 0.005 mm~0.0015 mm.

The nodular graphite cast iron may additionally include 0.2 wt % to 0.8 wt % of molybdenum (Mo).

The nodular graphite cast iron may additionally include 0.05 wt % to 0.5 wt % of tungsten (W).

The nodular graphite cast iron may additionally include 0.01 wt % to 0.3 wt % of boron (B).

According to another aspect of the present invention, there is provided a method for fabricating a vane for a compressor, including a melting step of fabricating a molten metal including 3.4 wt % to 3.9 wt % of carbon (C), 2.0 wt % to 3.0 wt % of silicon (Si), 0.3 wt % to 1.0 wt % of manganese (Mn), 0.1 wt % to 1.0 wt % of chromium (Cr), 0.04 wt % to 0.15 wt % of titanium (Ti), less than 0.08 w % of phosphorus (P), less than 0.025 wt % of sulphur (S), 0.03 wt % to 0.05 wt % of magnesium (Mg), 0.02 wt % to 0.04 wt % of rare earth resource, and iron (Fe) and impurities as the remnants; a casting step of injecting the molten metal to a mold and cooling the same to obtain a semi-product including nodular graphite and 15 vol % to 35 vol % of carbide; a grinding step of grinding the cooled semi-product to have a predetermined shape; and a heat treatment step of thermally treating the grinded product to transform an austenite matrix structure into a bainite matrix structure.

Here, the method may further include a spheroidizing step of taking out the molten metal and applying a spheroidizing agent to the molten metal.

Also, the heat treatment step may include: heating the grinded semi-product to reach 880° C. to 950° C. and maintaining the semi-product at the temperature for 30 to 90 minutes; maintaining the semi-product in a liquid having a temperature ranging from 200° C. to 260° C. for one to three hours; and cooling the semi-product in the air to reach room temperature. In this case, the liquid may be a nitrate solution in which KNO3 and NaNO3 are mixed in the weight ratio of 1:1.

The method may further include: a fine grinding step of finely grinding the heat treatment-completed semi-product.

The method may further include a sulphurizing step of forming a sulphurized layer having a thickness ranging from 0.005~0.0015 mm on a surface of the heat treatment-completed semi-product.

The vane may additionally include 0.2 wt % to 0.8 wt % of molybdenum (Mo).

The vane may additionally include 0.05 wt % to 0.5 wt % of tungsten (W).

The vane may additionally include 0.01 wt % to 0.3 wt % of boron (B).

According to another aspect of the present invention, there is provided a vane for a compressor fabricated by using the foregoing nodular graphite cast iron.

According to embodiments of the present invention, the bainite matrix structure includes a nodular graphite and 15 vol % to 35 vol % of carbide, and in this case, hardness of the carbide is so high that wear resistance can be enhanced and resistant to impact, and lubricity of the nodular graphite further strengthens wear resistance. In addition, the presence of the sulphurized layer further enhances the lubrication properties and wear resistance of the nodular graphite, and thus, even when a new refrigerant is used, a compressor can be stably driven.

In addition, since the content of a high-priced or rare earth element is very small, the price of a raw material can be considerably reduced. In addition, compared to the related art in which a vane is fabricated though a forging process which accompanies post-processing, a vane can be fabricated through a casting process allowing for fabrication of a plurality of vanes, and thus, a vane can be easily processed and precision thereof can be enhanced.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
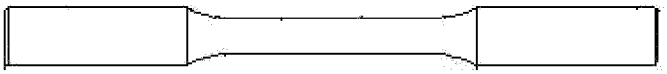
FIG. 1 is a front view schematically illustrating a sample for testing tensile strength of a nodular graphite cast iron according to an embodiment of the present invention.
Figure 2:
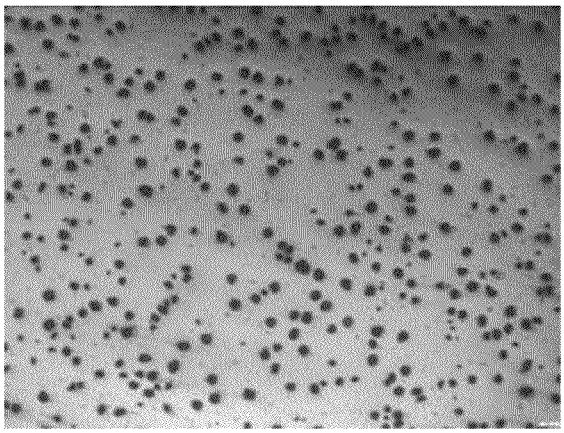
FIGS. 2 to 10 are photographs showing enlarged surface structures of a nodular graphite cast iron according to first to ninth embodiments of the present invention.
Figure 3:
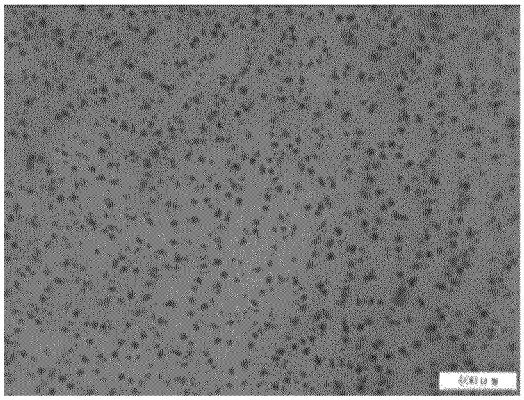
Figure 4:
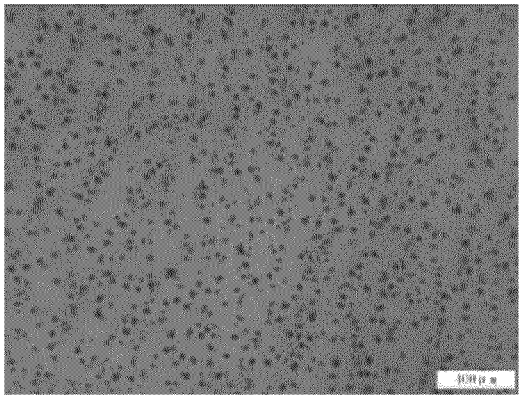
Figure 5:
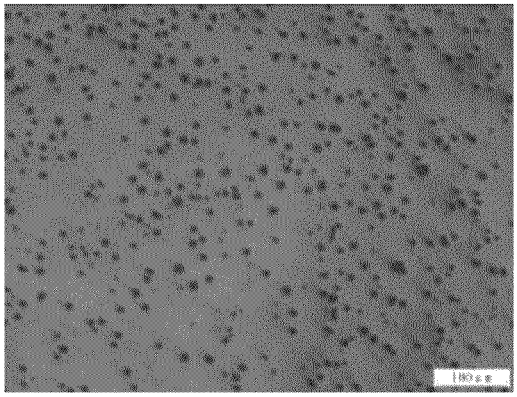
Figure 6:
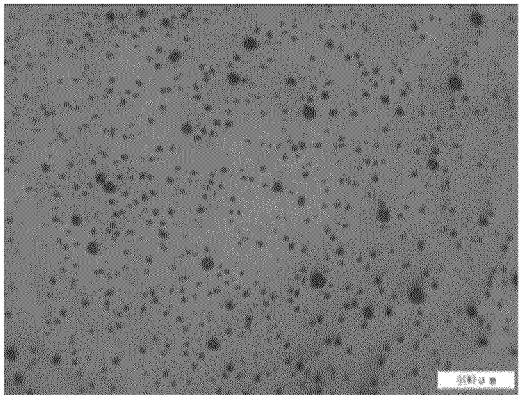
Figure 7:
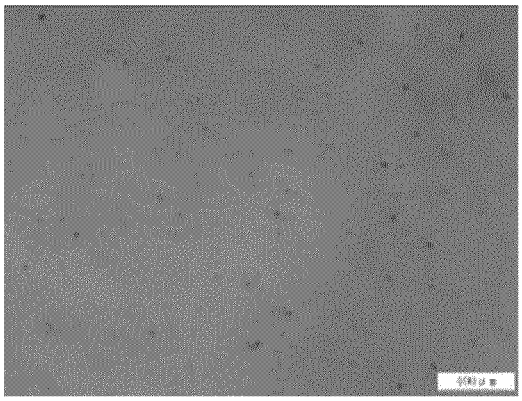
Figure 8:
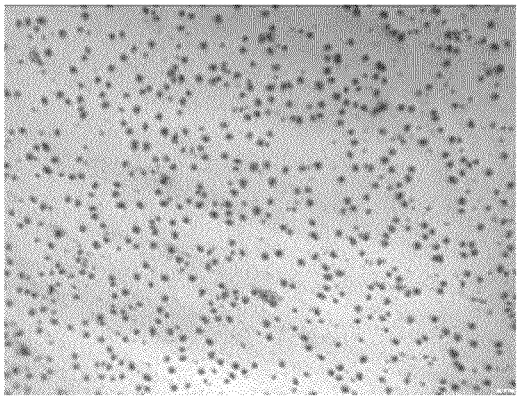
Figure 9:
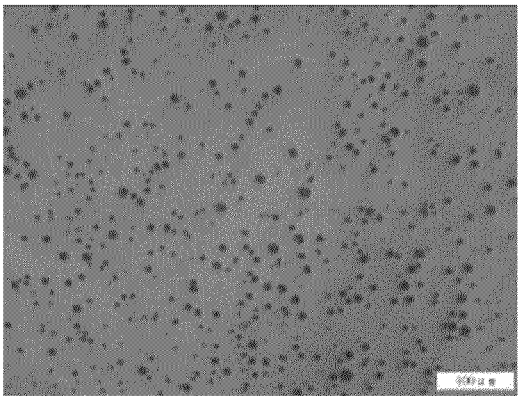
Figure 10:
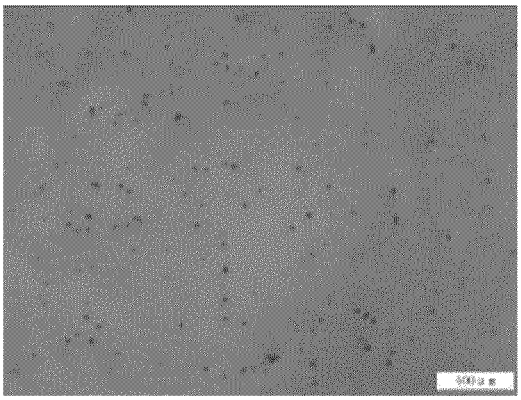

Embodiments of the present invention will be described in detail with reference to the accompanying drawings.

In general, cast iron has so high hardness as to have excellent wear resistance and machinability, but has low tensile strength and strong brittleness so it is rarely used as a member exposed to a high pressure atmosphere. In particular, in case of the foregoing vane of a compressor, since it slides upon being tightly attached to an adjacent component to prevent a leakage of a compressed refrigerant, as well as in a high pressure atmosphere, higher wear resistance than that of the related art is requested. In an embodiment of the present invention, nodular graphite cast iron that has high tensile strength and wear resistance by mixing various elements by appropriate contents so as to be used for various purposes is provided. Respective elements will be described. Here, each content is based on weight ratio unless otherwise indicated.

(1) Carbon (C): 3.4% to 3.9%.

Carbon present in cast iron exists as graphite or in the form of carbide represented by Fe3C. Thus, when the content of carbon is small, a majority of carbon exists in the form of carbide, so a nodular graphite structure does not properly appear. Thus, carbon is added in the amount of 3.4% or more to obtain an entirely uniform nodular graphite structure. Meanwhile, as the content of carbon is increased, a solidifying point is lowered, helping improve castability; however, deposition of graphite is excessively increased to raise brittleness and negatively affect tensile strength. Namely, the highest tensile strength can be obtained when carbon saturation (Sc) is about 0.8 to 0.9, so a maximum limit of carbon is determined to be 3.9% to obtain good tensile strength.

(2) Silicon (Si): 2.0% to 3.0%

Silicon, as a graphitizer, serves to decompose a carbide to precipitate graphite. Namely, an addition of silicon obtains an effect of increasing the amount of carbon. In addition, silicon serves to grow fine graphite structure present in cast iron into a flake graphite structure. The thusly grown flake graphite structure is generated as nodular graphite by magnesium, a spheroidizing agent, or the like. In particular, mechanical performance of the bainite matrix structure is increased according to an increase in the content of silicon (Si). Namely, when a large amount of silicon is added, the bainite matrix structure can be strengthened to enhance tensile strength, and this is conspicuous when the content of silicon is 3.0% or less. The reason is because, as the content of silicon is increased, a diameter of graphite is reduced and an amount of ferrite is increased to accelerate transformation into bainite.

Namely, when Si/C is increased, the amount of graphite is reduced so the high content of silicon strengthens the matrix structure to enhance tensile strength, and this is more conspicuous when inoculation is performed on a molten metal.

However, when the content of silicon exceeds 3.0%, such an effect is saturated. In addition, when the content of silicon is excessively high, the content of carbide is reduced to lower hardness and wear resistance of the material, making it difficult for the material to be dissolved, and change an austenite structure into a martensite structure during a follow-up cooling process to increase brittleness. In addition, as the content of silicon is increased, heat conductivity is degraded, making a temperature distribution non-uniform during a cooling or heating operation, to increase residual stress. Thus, the content of silicon was determined to be 2.0% to 3.0%.

(3) Manganese (Mn): 0.3% to 1.0%

Manganese, a white cast iron acceleration element inhibiting graphitization of carbon, serves to stabilize combined carbon (i.e., cementite). Also, manganese inhibits precipitation of ferrite and reduces the size of pearlite, so manganese is useful in case of making a matrix structure of cast iron pearlite. In particular, manganese is bonded with sulfur of cast iron to create manganese sulphide. Manganese sulphide floats off the surface of a molten metal so as to be removed as slag, or is coagulated and remains as a non-metallic inclusion in the cast iron to prevent a generation of iron sulfide. Namely, manganese also acts as an element for neutralizing harmfulness of sulfur. In order to accelerate formation of pearlite and remove a sulfur ingredient, manganese is contained in the amount of 0.3% to 1.0%.

(4) Chromium (Cr): 0.1% to 1.0%

When a large amount of chromium, an element inhibiting graphitization, is added, graphite is changed to white cast iron and hardness is excessively enhanced to degrade machinabilty. Meanwhile, chromium acts to stabilize the carbide and help to enhance heat resistance. Thus, chromium is added in the amount of 0.1% to 1.0% to enhance mechanical performance and heat resistance. In addition, chromium enhances hardenability and serves to stabilize pearlite cast iron in case of eutectoid transformation.

(5) Molybdenum (Mo): 0.2% to 0.8%

When contained in the amount of 0.8 or less, molybdenum acts to stabilize carbide and reduces the size of pearlite and graphite. When molybdenum is added, an amount of phosphorus should be lowered. Otherwise, a four-dimensional P—Mo eutectic is formed to increase brittleness. Meanwhile, molybdenum serves to improve uniformity of a section structure, enhance strength, hardness, impact strength, fatigue strength, high temperature (550° C. or lower) performance, reduce shrinkage, improve heat treatment characteristics, and enhance hardenability. With these factors considered, the content of molybdenum is determined to be 0.2% to 0.8%.

(6) Boron (B): 0.05% to 0.5%

Boron reduces the size of graphite but it also reduces an amount of graphite and promotes formation of carbide. In particular, boron carbide is formed to have a net shape, and when the content of boron is small, the net shape has a discontinued shape, but when the content of boron is excessive, a continuous net is formed to degrade mechanical performance. Thus, boron is contained in the amount of 0.05% to 0.5%.

Here, in case of Si/B<80, a discontinued net is formed, in case of 80<Si/B<130, a small amount of boron carbide is formed, and in case of Si/B>130, a continued net is formed. Thus, in association with the content of silicon, the content of boron is adjusted to obtain Si/B<80.

(7) Titanium (Ti): 0.04% to 0.15%

Titanium reduces the size of graphite, accelerates formation pearlite, and enhances high temperature stability of pearlite. In addition, titanium has strong denitrification and deoxidation with respect to a molten metal. Thus, when titanium is added, graphitization is accelerated. Since titanium reduces a size of graphite, it increases tensile strength, prevents chilling, and improves wear resistance. To this end, titanium is contained in the amount of 0.04% to 0.15%.

(8) Tungsten (W): 0.05% to 0.5%

Tungsten is a metal having a high melting point, belonging to a sixth period group elements on the periodic table. Tungsten, a metal in silver-white color, has an eternal appearance similar to that of steel. Meanwhile, carbide of tungsten has very high hardness, wear resistance, and anti-fusibility. Thus, tungsten carbide may be formed by appropriately putting tungsten in nodular graphite cast iron, thereby enhancing hardness. In addition, tungsten, as an element accelerating formation of pearlite, is contained in the amount of 0.05% to 0.5%.

(9) Rare earth resource (RE): 0.02% to 0.04%

Rare earth resource serves as a spheroidizing agent and is contained in the amount of 0.02% to 0.04%.

(10) Phosphorous (P): 0.3% or less

Phosphorous forms a compound of iron phosphide ($Fe_3P$) to exist as ternary eutectic steadite together with ferrite and iron carbide. Iron phosphide is easily supercooled and easily cause segregation in casting. Thus, as the content of phosphorous is increased, brittleness is increased and tensile strength is sharply reduced. The content of phosphorous is determined to be 0.3% or less.

(11) Sulfur (S): 0.1% or less

As an amount of sulfur is increased, fluidity of a molten metal is degraded, shrinkage is increased, and shrinkage cavities or cracks may be generated. Thus, preferably, sulfur is contained as small as possible. In this case, when sulfur is contained in the amount of 0.1% or less, such a bad influence is not greatly made, so sulfur is managed to be contained in the foregoing content.

Nodular graphite cast iron may be produced by mixing the elements having the foregoing characteristics, and used for fabricating a vane of a compressor. Hereinafter, a process of fabricating a compressor vane made of the nodular graphite cast iron will be described.

(1) Smelting

A raw material is prepared by selecting the foregoing elements in appropriate ratios, put in a middle frequency induction furnace, heated such that the raw material is entirely dissolved, and then, smelted. In this case, a temperature for taking the molten metal from the furnace is about 1,500° C. to 1,550° C.

(2) Spherioidization and inoculation

A spheroidizing agent for spheroidizing graphite and an inoculant are inoculated to the molten metal smelted in the smelting process. Here, as the spheroidizing agent, a spheroidizing agent including magnesium (Mg), calcium (Ca), rare earth resource (RE) known as an element accelerating spheroidization of graphite may be used. In detail, a spheroidizing agent having ingredients such as Mg:5.5-6.5%, Si:44-48%, Ca:0.5-2.5%, AL<1.5%, RE:0.8-1.5%, MgO<0.7% is added in the amount of 1.0% to 1.8% over the mass of the molten metal.

Meanwhile, inoculation accelerates graphitization by generating a great amount of graphite nucleus, and helps to increase strength by making a graphite distribution uniform. As an inoculant, barium silicon iron alloy (FeSi72Ba2) is used, and the content is 0.4% to 1.0% of the mass of the molten metal.

(3) Casting

The molten metal inoculated in the inoculation process is injected to a mold previously fabricated to have a cavity having a desired shape. Here, casting is performed by using a shell mold process using resin-coated sand or an investment mold process. A cooled vane semi-product contains nodular graphite and carbide, and the content of the carbide is about 15% to 35% of the total volume of the vane. For example, $Fe_3C$ or the like, called iron carbide is included.

(4) Grinding.

The vane semi-product obtained in the casting process is grinded to have an intended shape.

(5) Heat Treatment

A heat treatment process is a type of austempering for changing austenite matrix structure into bainite. Austempering refers to a process of maintaining the austenite matrix structure in an austenite state at a temperature of Ms point or higher, quenching it in a salt bath, and air-cooling the same. Here, quenching refers to maintaining the supercooled austenite at a constant temperature until when austenite is completely transformed into bainite.

In detail, a vane semi-product having a grinded pearlite matrix structure is heated to reach a temperature ranging from 880° C. to 950° C. by using an electric resistance furnace which is able to control air temperature, maintained for about 30 to 90 minutes, quickly put in a nitrate solution having a temperature ranging from 200° C. to 260° C., maintained for about one to three hours, and then, taken out to be cooled at room temperature in the air. Through such a heat treatment, the austenite matrix structure is transformed into a bainite matrix structure, and accordingly, toughness and impact resistance can be drastically improved. Namely, when the heat treatment is completed, a vane containing the bainite matrix structure, the carbide, and the nodular graphite can be obtained.

Here, the nitrate solution in which $KNO_3$ and $NaNO_3$ are mixed in the ratio of 1:1 by weight ratio. The nitrate solution is a quenching medium having advantages in comparison to general quenching oil. The advantages are as follows.

During a nitrate solution quenching process, there is no steam film step and a high temperature zone cooling speed is very fast, so a thick workpiece can have a good quenching structure.

In a low temperature zone isothermal process, the nitrate solution has a cooling speed close to 0, causing very small distortion during quenching.

A cooling speed of the nitrate can be adjusted by adjusting the content of water (which comes between a hot oil cooling speed and a quadruple of an oil cooling speed), which is, thus, very convenient.

A surface of a workpiece shows a stress compression state, cracking of the workpiece tends to be reduced, and a life span of the workpiece is lengthened.

After quenching, the workpiece has a pale indigo blue color with uniform metal gloss, is not required to be channeled or pinned after being washed, and has high corrosion resistance performance.

(6) Fine Grinding and Polishing

The vane of the nodular graphite cast iron of carbide obtained through the heat treatment is subjected to fine grinding and polishing machining to have a final configuration and required surface quality.

(7) Sulphurizing

The vane of the nodular graphite cast iron obtained from the fine grinding and polishing process is sulphurized to form a sulphurized layer having a thickness ranging from 0.005 to 0.015 mm on a surface of the vane. The sulphurized layer acts together with the nodular graphite existing in the vane to further enhance lubricity and wear resistance of the vane. Here, the sulphurized layer may not be necessarily included, but is advantageous to improve wear resistance and lubricity when a new refrigerant, or the like, is used in a high compression ratio.

Embodiment 1

Embodiment 1 was fabricated through the following process.

A raw material was prepared by mixing C:3.4%, Si:2.0%, Mn:0.3%, Cr:0.1%, Ti:0.04%, P<0.08%, S<0.025%, Mg:0.03%, and Re:0.02% by element mass percentage and Fe as the remnant, and put into an intermediate frequency induction furnace. A temperature was raised in order to make the raw material entirely dissolved and the raw material was smelted into a molten metal of nodular graphite cast iron. The molten metal was taken out from the furnace at a temperature of 1,500° C.

Spheroidization and inoculation were performed on the molten metal of the nodular graphite cast iron which has been smelted and taken out from the furnace, and in this case, a spheroidizing agent was a rare earth silicon iron magnesium alloy FeSiMg6RE1, which was added in the amount of 1.0% of the mass of the raw solution, and an inoculant was a barium silicon iron alloy (FeSi72Ba2), which was added in the amount of 0.4% of the mass of the raw solution.

In the foregoing process, the molten metal of the nodular graphite cast iron which was subjected to inoculation were casted through a shell mold process or an investment mold process to obtain a pearlite cast iron vane including flake graphite and carbide, and in this case, the content of the carbide was 15% of the total volume of the vane.

The vane obtained from the foregoing step was grinded to obtain an intended shape.

Thereafter, the vane was heated up to a temperature of 880° C. and maintained at the temperature for 30 minutes. Thereafter, the vane was put in a nitrate solution having a temperature of 200° C., maintained for one hour, taken from the solution, and cooled at room temperature to transform the matrix structure into austenite. Here, the structure included austenite, carbide, nodular graphite, and a small amount of martensite. The obtained vain semi-product was subjected to fine grinding and polishing, and then, subjected to sulphurizing to form a sulphurized layer having a thickness of 0.005 mm on the surface of the vane.

Embodiment 2

In case of Embodiment 2, a raw material including C:3.7%, Si:2.5%, Mn:0.6%, Cr:0.5%, Mo:0.4%, W: 0.25%, B:0.05%, Ti:0.09%, P<0.08%, S<0.025%, Mg:0.04%, and Re:0.03% by element mass percentage and Fe as the remnant was dissolved and a molten metal was taken out at a temperature of 1,525° C. Then, an inoculant and spheroidizing agent are injected into the molten metal. In this case, a spheroidizing agent was a rare earth silicon iron magnesium alloy FeSiMg6RE1, which was added in the amount of 1.4% of the mass of the raw solution, and an inoculant was a barium silicon iron alloy (FeSi72Ba2), which was added in the amount of 0.7% of the mass of the raw solution. Thereafter, the molten metal was casted through a shell mold process or an investment mold process to obtain a vane semi-product in which carbide was 25 vol %.

The vale was grinded, heated up to a temperature of 915° C., maintained at the temperature for one hour, put in a nitrate solution having a temperature of 230° C., maintained for one to three hours, taken out and cooled in the air to reach room temperature to obtain a vane of austenite nodular graphite cast iron. The van was finely grinded and polished and sulphurized to form a sulphurized layer having a thickness of 0.008 mm on the surface of the vane.

Embodiment 3

A raw material including C:3.9%, Si:3.0%, Mn:1.0%, Cr:1.0%, Mn:0.8%, W:0.5%, B:0.1%, Ti:0.15%, P<0.08%, S<0.025%, MG:0.05%, and Re:0.04% by element mass percentage and Fe as the remnant was dissolved and taken out at a temperature of 1,550° C., and 1.8% of a spheroidizing agent FeSiMg6RE1 and 1.0% of an inoculant FeSi72Ba2 over the mass of the molten metal were added thereto. Thereafter, the molten metal was casted through a shell mold process or an investment mold process to obtain a vane including 35 vol % of carbide and the vane was grinded to have a certain shape.

The grinded vane was heated up to 950° C., maintained at the temperature for 1.5 hours, put in a nitrate solution having a temperature of 260° C., and then, cooled in the air to reach room temperature to obtain a vane including an austenite matrix structure, carbide, and nodular graphite. Thereafter, a final shape of the vane was obtained through fine grinding and polishing and the vane was sulphurized to form a sulphurized layer having a thickness of 0.015 mm on the surface of the vane.

Embodiment 4

A raw material including C:3.5%, Si:2.2%, Mn:0.4%, Cr:0.3%, Mo:0.2%, Ti:0.06%, P<0.08%, S<0.025%, Mg:0.035%, and Re:0.025% by element mass percentage and Fe as the remnant was melted, and the molten metal was taken out at a temperature of 1,510° C. The other remaining process was the same as that of Embodiment 1.

Embodiment 5

A raw material including C:3.6%, Si:2.3%, Mn:0.5%, Cr:0.4%, W:0.3%, Ti:0.07%, P<0.08%, S<0.025%, Mg:0.036%, and Re:0.026% by element mass percentage and Fe as the remnant was melted, and the molten metal was taken out at a temperature of 1,520° C. The other remaining process was the same as that of Embodiment 2.

Embodiment 6

A raw material including C:3.7%, Si:2.4%, Mn:0.7%, Cr:0.6%, B:0.3%, Ti:0.08%, P<0.08%, S<0.025%, Mg:0.042%, and Re:0.032% by element mass percentage and Fe as the remnant was melted, and the molten metal was taken out at a temperature of 1,530° C. The other remaining process was the same as that of Embodiment 3.

Embodiment 7

A raw material including C:3.8%, Si:2.6%, Mn:0.8%, Cr:0.7%, Mo:0.2%, W:0.5%, Ti:0.04%, P<0.08%, S<0.025%, Mg:0.036%, and Re:0.035% by element mass percentage and Fe as the remnant was melted, and the molten metal was taken out at a temperature of 1,540° C. The other remaining process was the same as that of Embodiment 1.

Embodiment 8

A raw material including C:3.5%, Si:3.0%, Mn:0.3%, Cr:0.9%, Mo:0.8%, B:0.01%, Ti:0.08%, P<0.08%, S<0.025%, Mg:0.03%, and Re:0.04% by element mass percentage and Fe as the remnant was melted, and the molten metal was taken out at a temperature of 1,550° C. The other remaining process was the same as that of Embodiment 2.

Embodiment 9

A raw material C:3.9%, Si:2.0%, Mn:1.0%, Cr:0.1%, W:0.05%, B:0.1%, Ti:0.15%, P<0.08%, S<0.025%, Mg:0.05%, and Re:0.02% by element mass percentage and Fe as the remnant was melted, and the molten metal was taken out at a temperature of 1,510° C. The other remaining process was the same as that of Embodiment 3.

The foregoing embodiments are organized in Table 1 shown below.

TABLE 1

| | C | Si | Mn | Cr | Mo | W | B | Ti | P | S | Mg | RE |
|---|---|---|---|---|---|---|---|---|---|---|---|---|
| 1 | 3.4 | 2.0 | 0.3 | 0.1 | | | | 0.04 | 0.08 | 0.025 | 0.03 | 0.02 |
| 2 | 3.7 | 2.5 | 0.6 | 0.5 | 0.4 | 0.25 | 0.05 | 0.09 | 0.08 | 0.025 | 0.04 | 0.03 |
| 3 | 3.9 | 3.0 | 1.0 | 1.0 | 0.8 | 0.5 | 0.1 | 0.15 | 0.08 | 0.025 | 0.05 | 0.04 |
| 4 | 3.5 | 2.2 | 0.4 | 0.3 | 0.2 | | | 0.06 | 0.08 | 0.025 | 0.035 | 0.025 |
| 5 | 3.6 | 2.3 | 0.5 | 0.4 | | 0.3 | | 0.07 | 0.08 | 0.025 | 0.036 | 0.026 |
| 6 | 3.7 | 2.4 | 0.7 | 0.6 | | | 0.3 | 0.08 | 0.08 | 0.025 | 0.042 | 0.032 |
| 7 | 3.8 | 2.6 | 0.8 | 0.7 | | 0.5 | | 0.04 | 0.08 | 0.025 | 0.036 | 0.035 |
| 8 | 3.5 | 3.0 | 0.3 | 0.9 | 0.8 | | 0.01 | 0.08 | 0.08 | 0.025 | 0.03 | 0.04 |
| 9 | 3.9 | 2.0 | 1.0 | 0.1 | | 0.05 | 0.1 | 0.15 | 0.08 | 0.025 | 0.025 | 0.02 |

Samples which were completely casted in the foregoing embodiments were collected and surfaces thereof were grinded, hardness test was performed on five points of the respective embodiments by using an HB-3000 type hardness tester, diameters of the formed recesses were measured by using a microscope, hardness was calculated based on the measured diameters, and an average value of the five points was determined as hardness of the samples.

In addition, hardness of samples which underwent a heat treatment was tested by using an HR-150A type Rockwell hardometer. As for test positions, upper and lower two points in the vicinity of a casting solution injection hole, upper and lower two points away from the casting solution injection hole, and one point therebetween were determined, and testing was performed on the total five points.

Also, a test sample having the form illustrated in FIG. 1 was fabricated with the same material as those of the respective embodiments, and tensile strength thereof was measured. Table 2 below shows test results.

TABLE 2

| Ingredient No. | 1 | 2 | 3 | 4 | 5 | 6 | 7 | 8 | 9 |
|---|---|---|---|---|---|---|---|---|---|
| Cast state hardness (HB) | 347 | 379 | 372 | 328 | 324 | 472 | 321 | 367 | 458 |
| Hardness after heat treatment (HRC) | 62.5 | 63.8 | 63.6 | 61.9 | 60.9 | 62.3 | 61.8 | 62.4 | 61.8 |
| Tensile strength ($N/mm^2$) | 433 | 413 | 405 | 435 | 458 | 330 | 440 | 435 | 370 |

As illustrated in Table 2, all the embodiments of the present invention have hardness of 60 or greater based on Rockwell hardness, so it can be said that they have sufficient hardness as a vane of a compressor. In addition, such high hardness characteristics are associated with lubricity of the nodular graphite to drastically enhance wear resistance.

Table 3 below shows test results of machinability and abradability in the foregoing embodiments

TABLE 3

| | Particulars | Embodiment | High speed steel |
|---|---|---|---|
| Machinability | Load rate | 60% | 100% |
| | Tool life span (per unit) | 300 | 100 |

TABLE 3-continued

| | Particulars | Embodiment | High speed steel |
|---|---|---|---|
| grinding workability | Load rate | 75% | 100% |
| | Grinding stone dressing period | 800/once | 500/once |

In terms of cuttability, in the case of the nodular graphite cast iron according to an embodiment of the present invention, it exhibits a cutting load corresponding to 60% when the related art high speed steel is 100%, so it can be seen that the nodular graphite cast iron according to an embodiment of the present invention can easily perform cutting relative to the high speed steel. In addition, a tool made of the high speed steel is able to cut 100 vanes, but a tool made of the nodular graphite cast iron according to an embodiment of the present invention can cut 300 vanes, which is triple. Therefore, a frequent replacement of the tool may be prevented and a time taken for the cutting may be shortened, resulting in improvement of productivity.

Also, in terms of the grinding workability, the grinding load of the alloy cast iron may correspond to 75% of the high speed steel, 800 vanes may be ground per one-time dressing for the grinding stone. It may thusly be understood that the grinding property remarkably increases as compared with the high speed steel.

Also, a vane using the high speed steel has a low productivity because of the use of forging other than casting, whereas the vane according to the present disclosure may be manufactured by casting so as to have relatively excellent machinability even with abrasion resistance, which is similar to that of the high speed steel. Accordingly, the productivity and manufacturing costs for the vane according to the present disclosure may be remarkably reduced.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A nodular graphite cast iron comprising:
3.4 wt % to 3.9 wt % of carbon ((C);
2.0 wt % to 3.0 wt % of silicon (Si);
0.3 wt % to 1.0 wt % of manganese (Mn);
0.1 wt % to 1.0 wt % of chromium (Cr);
0.04 wt % to 0.15 wt % of titanium (Ti);
less than 0.08 wt % of phosphorus (P);
less than 0.025 wt % of sulphur (S);
0.03 wt % to 0.05 wt % of magnesium (Mg);
0.02 wt % to 0.04 wt % of rare earth resource;
iron (Fe) and impurities as the remnants; and
a bainite matrix structure, nodular graphite, and 15 vol % to 35 vol % of carbide.

2. The nodular graphite cast iron of claim 1, further comprising:
a spheroidizing agent and an inoculant added to a molten state of the nodular graphite cast iron.

3. The nodular graphite cast iron of claim 2, wherein the spheroidizing agent is added in the amount of 1.0%~1.8% of a mass of the molten nodular graphite cast iron.

4. The nodular graphite cast iron of claim 1, wherein the bainite matrix structure of the nodular graphite cast iron is obtained by transforming an austenite matrix structure through a heat treatment.

5. The nodular graphite cast iron of claim 4, wherein the heat treatment is performed by heating to a temperature ranging from 880° C. to 950° C., maintained at the temperature for 30 to 90 minutes, maintained in a liquid at a temperature ranging from 200° C. to 260° C. for 1 to 3 hours, and then, cooled to reach room temperature.

6. The nodular graphite cast iron of claim 5, wherein the liquid is a nitrate solution in which $KNO_3$ and $NaNO_3$ are mixed in the weight ratio of 1:1.

7. The nodular graphite cast iron of claim 4, wherein the nodular graphite cast iron having the transformed bainite matrix structure is sulphurized to further include a sulphurized layer having a thickness ranging from 0.005 mm~0.0015 mm.

8. The nodular graphite cast iron of claim 1, further comprising 0.2 wt % to 0.8 wt % of molybdenum (Mo).

9. The nodular graphite cast iron of claim 1, further comprising 0.05 wt % to 0.5 wt % of tungsten (W).

10. The nodular graphite cast iron of claim 1, further comprising 0.01 wt % to 0.3 wt % of boron (B).

* * * * *